US005726143A

United States Patent [19]

Petraia et al.

[11] Patent Number: 5,726,143

[45] Date of Patent: Mar. 10, 1998

[54] ANTI-STATIC DEVICE

[76] Inventors: Teresa M. Petraia, 1 Barjune Rd., Norwalk, Conn. 06851; Paul R. Purvis, 19 Sleepy Hollow Rd., Ridgefield, Conn. 06877; William T. Ahlborn, 131 Beard Dr., New Milford, Conn. 06776

[21] Appl. No.: 742,648

[22] Filed: Nov. 1, 1996

[51] Int. Cl.[6] ..... D06M 10/08

[52] U.S. Cl. ..... 510/519; 428/365; 428/195; 428/212; 428/98; 442/102; 442/115; 427/402; 427/412; 427/258; 427/288; 427/384; 427/394; 427/242

[58] Field of Search ..... 510/519; 427/402, 427/412, 258, 288, 384, 394, 242; 428/365, 195, 212, 98; 442/102, 115

[56] References Cited

U.S. PATENT DOCUMENTS

| | | | |
|---|---|---|---|
| 2,665,528 | 1/1954 | Sternfield | 51/185 |
| 3,843,395 | 10/1974 | Morton . | |
| 3,895,128 | 7/1975 | Gaiser | 428/43 |
| 4,022,938 | 5/1977 | Zaki et al. | 427/242 |
| 4,025,444 | 5/1977 | Murphy et al. . | |
| 4,110,498 | 8/1978 | Benjamin et al. | 428/35 |
| 4,113,630 | 9/1978 | Hagner et al. . | |
| 4,118,525 | 10/1978 | Jones | 427/242 |
| 4,229,475 | 10/1980 | Barrett et al. | 428/196 |
| 4,291,072 | 9/1981 | Barrett et al. | 427/243 |
| 4,389,448 | 6/1983 | Green | 428/195 |
| 4,642,258 | 2/1987 | Majewski et al. | 428/68 |
| 4,663,198 | 5/1987 | Norris | 427/264 |
| 5,145,595 | 9/1992 | Morris et al. | 252/91 |
| 5,208,089 | 5/1993 | Norris | 428/136 |
| 5,300,238 | 4/1994 | Lin et al. | 510/520 |

*Primary Examiner*—Alan Diamond

[57] ABSTRACT

The present invention relates to an article for improving anti-static protection of clothing dried in a clothes dryer. The article includes a substrate, a layer comprising a first quaternary ammonium anti-static agent that has a first melting point. The layer comprising the first quaternary ammonium anti-static agent is adhered to the substrate. The article also includes a layer comprising a second quaternary ammonium anti-static agent that is adhered to the first quaternary ammonium anti-static agent. The layer comprising the second quaternary ammonium anti-static agent has a melting point lower than the first melting point. The present invention also includes a method for making the article.

18 Claims, No Drawings

ANTI-STATIC DEVICE

BACKGROUND OF INVENTION

The present invention relates to an anti-static device and to a method for reducing a static charge on clothing.

Clothing, particularly polymer-based clothing, is susceptible to acquiring a static charge when two surfaces of the clothing are rubbed together. This static charge causes one surface of an article of clothing to cling to another surface. The phenomenon is known as "static cling" and is typically regarded as unsightly and uncomfortable. Methods of dealing with static charge, to date, have included a use of chemicals, such as ammonium ion based chemicals, to neutralize the charge on the surface of clothing and to prevent a transfer of electrons causing static charge. These agents, called anti-static agents, have, in some embodiments, been sprayed onto cloth or an article of clothing at a time that an individual wears the clothing. In other embodiments, the anti-static agents are applied to a cloth or paper article. The cloth or paper article is then placed in a device such as a dryer with clothing. The anti-static agent on the cloth or paper melts, volatilizes, and contacts surfaces of the clothing when heated in the dryer. Once the surfaces of the clothing are contacted, static charge on the surfaces is reduced.

One disadvantage of anti-static agents employed to date has been that the effectiveness of the agents tends to be limited in time. Consequently, the anti-static agent must be repeatedly applied to a surface in order to prevent static charge.

The Murphy, et at. patent, U.S. Pat. No. 4,025,444, issuing May 24, 1977, describes a use of an alkyl ammonium carbamate as an anti-static agent. The alkyl ammonium carbamate materials are combined with anionic detergents or softening agents.

The Benjamin, et at. patent, U.S. Pat. No. 4,110,498, issuing Aug. 29, 1978, describes a use of paper, or cloth, which acts as a carrier, for carrying a fabric softening agent. The fabric softening agent on the carrier is added to a dryer. The softening agent is released from the carrier when heated in the dryer. The cationic softening agent is described as including cationic quaternary ammonium salts. Lanolin alcohol is mixed with the softener.

The Jones patent, U.S. Pat. No. 4,118,525, issuing Oct. 3, 1978, describes a cloth or paper article that may be added to a dryer. The article has a fabric softener adhered to it. The '525 patent describes an anti-static device with a dispersion inhibitor distributed over the device as a layer and a quaternary ammonium compound layer beneath the dispersion inhibitor layer. The patent notes that the quaternary ammonium compound may not be placed in a layer on top of the dispersion inhibitor. The patent also requires that each layer be continuous. The patent describes that the dispersion inhibitor layer completely covers the quaternary ammonium compound.

The Majewski, et al. patent, U.S. Pat. No. 4,642,258, issuing Feb. 10, 1987, describes a method for controlling viscosity and release rate of fabric treating agents. The method includes treating a quaternary ammonium salt with a polyalkyl oxide and silica. The silica aids in thickening the ammonium salt. The Morris, et al. patent, U.S. Pat. No. 5,145,595, issuing Sep. 8, 1992, describes an anti-static composition that includes an ethoxylated alcohol, a fatty alcohol and a storage stabilizer, such as a clay.

SUMMARY OF THE INVENTION

The present invention includes an article for improving anti-static protection of clothing dried in a clothes dryer. The article includes a substrate and a layer comprising a first quaternary ammonium anti-static agent having a first melting point that is adhered to the substrate. The article also includes a layer comprising a second quaternary ammonium anti-static agent adhered to the first quaternary ammonium anti-static agent having a second melting point which is lower than the first melting point.

The present invention also includes an article that signals depletion of an anti-static agent. The article includes a substrate and a layer comprising a first anti-static agent adhered to the substrate. A colorant is blended with the first anti-static agent. The colorant and anti-static agent blend adhere to the substrate forming a colored, anti-static layer.

The present invention further includes a method for improving anti-static protection of clothing dried in a clothes dryer. The method includes providing an article that includes a substrate, a layer comprising a first quaternary ammonium anti-static agent adhered to the substrate having a first melting point, and a layer comprising second quaternary ammonium anti-static agent adhered to the first substrate, having a second melting point lower than the first melting point. This article is added to a clothes dryer with clothes to be dried. The article and clothes are dried in the clothes dryer at a temperature effective to release the second quaternary ammonium agent and then the first quaternary ammonium agent.

The present invention additionally includes a method for increasing a time interval for anti-static protection of clothing dried in a clothes dryer. The method includes providing a substrate and applying a layer comprising a first quaternary ammonium anti-static agent to the substrate. The anti-static agent has a first melting point. The layer comprising a first quaternary ammonium anti-static agent is then overlaid with a layer comprising a second quaternary ammonium anti-static agent having a second melting point which is lower than the first melting point.

The present invention also includes a method for signaling depletion of an anti-static agent. The method includes providing a substrate and providing a layer comprising a first anti-static agent. A colorant is blended into the anti-static agent to form a blend. The colorant is added in a concentration low enough so as not to change melting point of the anti-static agent blend. The colorant and anti-static agent are applied to the substrate so that the colorant and anti-static agent blend overlays the substrate. A layer comprising a second anti-static agent is overlayed onto the layer comprising the first anti-static agent. The second anti-static agent melts at a temperature lower than the first anti-static agent. The substrate is heated with the anti-static agents and colorant blend in a dryer so that the anti-static agent and colorant volatilize at a rate proportional to each other.

DETAILED DESCRIPTION OF PREFERRED EMBODIMENTS

The present invention comprises an article for improving anti-static protection of clothing dried in a clothes dryer. The article comprises a substrate, a layer comprising a first quaternary ammonium anti-static agent having a first melting point that is adhered to the substrate, and a layer comprising a second quaternary ammonium anti-static agent adhered to the first quaternary ammonium anti-static agent, having a second melting point lower than the first melting point.

It has been found that by layering a second quaternary ammonium anti-static agent over a first quaternary ammonium anti-static agent that is adhered to a substrate, the second agent having a melting point lower than the first agent, that one can significantly extend the period of effectiveness for the new anti-static device as compared to a single layer with two quaternary ammonium anti-static agents blended together. When the device is subjected to heat in a dryer, the layers are sequentially released over time. As a consequence, clothing in a dryer is contacted with an anti-static agent for a longer period of time than has heretofore been possible.

Previous efforts have been directed to blending quaternary ammonium salts with each other or with other types of fabric softeners and anti-static compounds to form a single blend, rather than layering one quaternary ammonium anti-static compound over another quaternary ammonium anti-static compound. Additionally, layers bound with materials other than quaternary ammonium agents have been continuous layers rather than discrete layers.

The quaternary ammonium anti-static agents suitable for use in the device of the present invention include both water-soluble and substantially water-insoluble quaternary ammonium materials. For example, suitable materials include methyl diethanolamine based esterquat chloride, diethyl-di-hard tallow ammonium chloride, amidoimidazolinium chloride, triethanolamine based esterquat methyl sulfate, dimethyl-di hard tallow ammonium methyl sulfate, benzylkonium chloride, di-amido amine based quat, and methyl bis(polyethoxy ethanol) alkyl ammonium methyl sulfates. These quaternary ammonium anti-static agents may be used in either of the first or second layers. Non-ionic ethoxylated alcohols, a mix of fatty acids and fat, a mixture that includes primarily fats, or a mixture of any of these materials may be blended with one or more of the quaternary ammonium materials in order to, in part, adjust melting and vaporization points of a resulting blend.

Melting points of the first quaternary ammonium anti-static agent and second quaternary ammonium anti-static agent preferably differ by about 10°–30° C. so that the second quaternary ammonium anti-static agent melts at a temperature that is about 20°–30° C. lower than the first quaternary ammonium agent. In one preferred embodiment, the melting point difference between the first quaternary ammonium anti-static agent and second quaternary ammonium anti-STATIC agent is about 20° C. As discussed, melting point adjustments can be made in each layer by adjusting ratios of cationic quaternary ammonium anti-static agents to non-ionic materials in each layer. Melting point differences for the two layers can also be obtained by combining hydrophilic quaternary ammonium anti-static agents such as methyl bis(polyethoxy ethanol) alkyl ammonium methyl sulfates with one or more hydrophobic quaternary ammonium agents. Hydrophilic quaternary ammonium agents typically have lower melting point than non-hydrophilic quaternary ammonium agents. The hydrophilic agents are typically in a second or top layer.

Quaternary ammonium anti-static agents are usually in a solid or semi-solid form at room temperature and are melted in order to be applied to a substrate. Melting the agents in order to apply them to a substrate has no significant effect on the rate of release once the quaternary ammonium anti-static agents are dried and adhered onto the substrate.

In addition to quaternary ammonium anti-static agents, other ingredients may also be applied to the substrate in a quaternary ammonium anti-static blend. These ingredients include release agents and solvents, such as nonionic surfactants and aluminum silicate clays, stain resistant agents such as hydrophilic polymers, fatty acids, amides, perfumes, perfume carriers, biocides, optical brighteners and dyes. These ingredients may be blended with one or both of the two layers.

The quaternary ammonium anti-static agents used in the present invention may be prepared in various ways conventionally known in the art and many such materials are commercially available. The quaternaries are often made from alkyl halide mixtures corresponding to the mixed alkyl chain links in fatty acids. For example, the ditallowalkyl quaternaries are made from alkyl halides having mixed $C_{14}$–$C_{18}$ chain links.

Substantially any anionic group can be the counter ion in the quaternary compounds used in the present invention. Methylsulfate and chloride ions are preferred from an availability standpoint. Methylsulfate anion is preferred because of its reduced corrosive effects on an automatic clothes dryer.

Preferred quaternary ammonium anti-static agents for use in the first anti-static agent layer include agents having a melting point within a range of about 170 to 175 degrees Fahrenheit. The layer comprising the first anti-static agent layer is typically adhered to the substrate. One preferred anti-static agent for the first layer is a di methyl methyl sulfate based quaternary ammonium agent. The melting point of this layer can be increased by decreasing surfactant concentration in the layer.

The preferred quaternary ammonium anti-static agents for use as the second anti-static agent in the second or top anti-static agent layer include agents having a melting point within a range of 130° to 150° F. These agents include the di-tallow di-methyl sulfate having a MELTING point within a range of about 130°–140° F. and di-methyl sulfate quaternary ammonium compounds having a melting point within a range of about 140°–150° F. The lower melting point is achieved by increasing the surfactant concentration in the second or top layer. Hydrophilic quaternary ammonium agents are also suitable for use in the second or top layer. Layers made with blends of quaternary ammonium agents and other ingredients described above have melting points with the ranges described herein.

Substrates suitable for use in the device of the present invention are water-insoluble and substantially solid. The substrates may be dense or open. Acceptable substrates include foam, such as polyester foam, and non-woven cloth, such as polyester or rayon. The term "cloth" as used herein means a foam or a non-woven fabric or cloth. Substrates must maintain their structural integrity through the complete washing and drying cycles in which they are used. The substrates must have certain thermal stability characteristics. The substrates should not have a melting point or ignite at temperatures below about 300° F. in order to permit their use in automatic clothes dryers. In one embodiment, the substrate is in a sheet form. The sheet may be square, rectangular or other shape. During manufacture of the anti-static device, the sheet may be in the form of a web.

One embodiment of the anti-static device of the present invention includes a microparticle substrate. The microparticles may be solid or hollow spheres or may be porous spheres. The microparticles are typically made of a polymeric material which is substantially inert at temperatures effective for drying clothes. The microparticles substrate is coatable by the first quaternary ammonium anti-static agent. The second quaternary ammonium anti-static agent is then applied to the first agent to form a dual layer on the microparticle. The dual layer may be continuous or may be discrete.

The coated microparticles are then adhered to a substrate such as a fabric or cloth by a material that volatilizes at dryer temperatures. This material may itself be a quaternary ammonium agent or a mixture that includes a quaternary ammonium agent.

In another embodiment, the microparticles are coated with a single quaternary ammonium anti-static agent so that some of the particles are coated with the first quaternary ammonium anti-static agent and other particles are coated with the second quaternary ammonium anti-static agent. Each of these populations of particles may then be adhered to the cloth or fabric substrate by a single adhering layer. In another embodiment, the particle populations may be segregated into adhering layers on the cloth or fabric substrate. In this embodiment, microparticles coated with the first quaternary ammonium anti-static agent may be adhered to the substrate by a mixture that includes either of the first or second quaternary ammonium anti-static agents.

For another layered embodiment, it is contemplated that the anti-static agents are not microencapsulated but are separately layered over the substrate. Layering of the two quaternary ammonium anti-static agents may be continuous layering whereby a top layer covers a bottom or first layer. In another embodiment, the top layer forms a discrete pattern over the first or bottom layer wherein each of the top and bottom layers have exposed surfaces. The pattern may be ordered such as forming indicia or may be random.

In one embodiment, the substrate is a sheet and the first layer is applied at a rate of about 0.055 grams per square centimeter of sheet material. A rate within a range of 0.001 to 0.5 grams per square centimeter is suitable for use in the device of the present invention. In one embodiment, the sheet has dimensions of 7.75 inches by 10.5 inches. The sheets are obtained by detaching from a web.

While two layers have been described, the device of the present invention may include three or more layers, each having a melting point greater than the top layer. In one embodiment, each layer has a melting point lower than the melting point of the layer it overlays. One or more of the layers may be discrete. The discrete layer may form indicia. The melting temperature difference for any two layers that contact each other is within a range of about 10°–20° C.

The present invention also comprises an article that includes a mechanism that signals depletion of the anti-static agent. The article includes a substrate, such as has been described, a layer comprising an anti-static agent adhered to the substrate, and a colorant blended with the anti-static agent, forming the top or second layer. The colorant is added in a concentration that does not change the melting point of the anti-static agent blend with which it is blended. The colorant and anti-static agent blend adheres to the substrate to form a colored anti-static layer. When this layer is depleted, the device changes from a colored article to a white article. In one other embodiment, the colorant is applied directly to the substrate without prior blending with the anti-static agent.

Preferred anti-static agent blends include any of the agents and ingredients described above. In one embodiment, colorants include color stable dyes conventionally available. These dyes are typically dissolved in a base such as propylene glycol. Dye colors include blue, violet, orange, red and fluorescent colors. The dyes are added to a layer blend in a concentration effective to color the layer. The concentration is low enough so that the dyes do not alter the melting point of the layer.

With this embodiment, it is contemplated that as a top colored layer is heated, thereby melting and vaporizing the anti-static agent and the colorant, the anti-static device will fade in color, signaling a depletion of performance to a consumer. In another embodiment, the first or bottom layer is colored. With this embodiment, as the top layer melts and is vaporized, exposing the lower layer, the color in the anti-static device is intensified.

In another embodiment, each of the top and bottom layers includes a colorant. Each of the colorants are complimentary to each other, producing a third color when the device is fabricated. As the second or top layer melts and vaporizes, the color of the device changes. For instance, in one embodiment, the substrate is dyed blue. A layer dyed yellow is coated onto the blue substrate resulting in a green imprint. When the anti-static device is placed in a dryer and heat activated, the device turns blue, with the green color disappearing due to melting and vaporization.

In one additional embodiment, the substrate is colored. One or more of the quaternary ammonium anti-static layers may also be colored. Thus, with this embodiment, it is possible for a consumer to observe a change in the device of one or more colors as the layers comprising anti-static agents melt and vaporize. Layers may also be discrete forming indicia. As the anti-static device melts, the indicia change color.

The device of the present invention is made by selecting and preparing at least two quaternary ammonium anti-static agents and, as appropriate, blending these agents with materials such as non-ionic ethoxylated alcohols so that each of the layers formed by blending the agents has a melting point difference within a range of 10°–30° C. Materials for the first layer are blended and are melted for application to the substrate. The first layer may be applied to the substrate by any conventional method such as by spraying the material to be layered onto the substrate or by rolling the layer, with a roller onto the substrate. The first layer may be deposited uniformly to make a continuous layer on the substrate. In another embodiment, the first layer is sprayed in a dotted or stripped pattern over the substrate. In other embodiment, the first layer is applied with a roller having a raised pattern forming indicia that are transferred to the substrate.

Once the first layer is applied to the substrate, the first layer is permitted to dry and to adhere to the substrate. Once the first layer is dried and adhered, the second layer is applied. Like the first layer, the second layer may be sprayed in liquid form onto the first layer. The second layer is then permitted to dry. In another embodiment, a substrate with the first layer is dipped into a bath containing the second layer blend in a melted state. In this embodiment, the substrate is part of a web on a rotating roll. The second layer may be applied to form a continuous layer over the first layer. In another embodiment, the second layer is applied in a discrete manner to form a pattern such as a dotted pattern or a stripped pattern. The second layer may also be stamped onto the first layer with a roller having a raised pattern forming indicia that are transferred to the first layer and the substrate.

The first layer may also be applied to the substrate directly wherein the blend of the first layer is in a melted form and is in a bath through which the substrate Web is rotated. In another embodiment, the second layer is applied by a roll running in a bath of the second layer blend. The roll then transfers the material of the second layer to an application roll that transfers the material of the second layer to the web in synchronous time with the movement of the web. The web is permitted to cool and dry prior to rewinding.

Each of the first and second layers may also be applied to the anti-static device through a hot wax Video Jet process.

The hot wax is deposited utilizing either conventional heated bubble technology or a conventional high voltage droplet deflection method. The high voltage droplet deflection technique may be used to deflect material in order to form a pattern on the web utilizing either the first layer or the second layer or both layers.

In other embodiment, flakes of the quaternary ammonium anti-static agent blend are positioned on a substrate web. The web is then heated in order to melt the flakes. The melted flakes may be rolled onto the substrate in order to form a continous layer. The second layer may be applied to the first layer in a similar fashion. Specifically, flakes of the blend that includes the second quaternary ammonium anti-static agent are positioned on the first layer and are melted. The second layer may be uniformly distributed over the first layer by subjecting the second layer to a roller while the flakes are in a melted state. With this step, the second layer may be applied to form a continous layer over the first layer.

In another embodiment, the second layer is applied in a discrete manner to form a pattern such as a dotted pattern or a striped pattern. One or more of the first layer and second layer may be branded or selectively heated so as to remove material from the layer. The selected heating or branded may be performed using a heated die roll that runs in synchronous time with a substrate web. The selective removal may also be performed with a laser that scans the surface of one or more of the first and second layers to heat activate layer material and remove it or otherwise change its color or appearance.

The embodiment that includes one or more colorants may be prepared utilizing a method such as an offset method used in printing. With this method, the first layer is applied to the substrate. The substrate is in a form of a continous substrate web. The first layer is permitted to dry. The second layer is applied to the first layer with a roll that contacts a bath containing the blend of the second layer. The roll picks up material in the bath of the blend and transfers this material to a second roll, a dye roll. The dye roll transfers a dye to material transferred from the first roll. From the dye roll, the material is transferred to an application roll in synchronous time with the web. The application roll applies the dyed blend to the first layer of the substrate to form the second layer. The second layer is allowed to cool and dry prior to rewinding the substrate web. The dye roll may uniformly transfer a color or may transfer a character stamped on the roller or an outline of a character or a dye in reverse. The dye may also be applied to one or more of the first and second layer with a method such as a dot matrix dye whereby a dye or dyed material is applied with an applicator in the manner of an ink jet.

Although the present invention has been described with reference to preferred embodiments, workers skilled in the art will recognize that changes may be made in form and detail without departing from the spirit and scope of the invention.

What is claimed is:

1. An article for improving anti-static protection of clothing dried in a clothes dryer, comprising:

a substrate;

a layer comprising a first quaternary ammonium anti-static agent, having a first melting point adhered to the substrate; and a layer comprising a second quaternary ammonium anti-static agent adhered to the layer comprising the first quaternary ammonium anti-static agent having a second melting point lower than the first melting point.

2. The article of claim 1 and further including a colorant blended into the layer comprising the second quaternary ammonium anti-static agent wherein the colorant has a melting point that is about the same as the second quaternary ammonium anti-static agent.

3. The article of claim 1 wherein the layer comprising the second quaternary ammonium anti-static agent is applied to the layer comprising the first quaternary ammonium agent in a manner to form a continuous, uniform layer over the first quaternary ammonium anti-static agent.

4. The article of claim 1 wherein the layer comprising the second quaternary ammonium anti-static agent is positioned on the layer comprising the first quaternary ammonium agent so as to have discontinuities in the layer formed by the second quaternary ammonium anti-static agent.

5. The article of claim 4 wherein the discontinuities are in a shape of dots.

6. The article of claim 4 wherein the discontinuities are in a shape of stripes.

7. An article that signals depletion of an anti-static agent, comprising:

a substrate;

a layer comprising a first anti-static agent adhered to the substrate;

a colorant blended with the first anti-static agent wherein the colorant and the anti-static agent adhere to the substrate, forming a colored, anti-static layer; and a layer comprising a second anti-static agent that overlays the layer comprising the first anti-static agent.

8. The article of claim 7 wherein the substrate has a color that is complimentary to the colorant in the first anti-static agent.

9. The article of claim 7 wherein the layer comprising the second anti-static agent includes a colorant.

10. The article of claim 9 wherein the layer of the second anti-static agent is a continuous layer.

11. The article of claim 9 wherein the layer of the second anti-static agent is a discontinuous layer.

12. A method for improving anti-static protection of clothing dried in a clothes dryer, comprising:

providing an article that comprises a substrate; a layer comprising a first quaternary ammonium anti-static agent adhered to the substrate, having a first melting point; and a layer having a second quaternary ammonium anti-static agent adhered to the layer comprising the first substrate, having a second melting point lower than the first melting point;

adding the article to a clothes dryer with clothes to be dried; and drying the clothes in the clothes dryer at a temperature effective to release the second quaternary ammonium anti-static agent and then the first quaternary ammonium anti-static agent.

13. A method for increasing a time interval for anti-static protection of clothing dried in a clothes dryer, comprising:

providing a substrate;

applying a layer comprising a first quaternary ammonium anti-static agent to the substrate, the anti-static agent having a first melting point; and overlaying the first quaternary ammonium anti-static agent with a layer comprising a second quaternary ammonium anti-static agent having a second melting point lower than the first melting point.

14. The method of claim 13 wherein the layer comprising the second quaternary ammonium anti-static agent is overlaid in a manner to form a continuous layer over the layer comprising the first quaternary ammonium anti-static agent.

15. The method of claim 13 wherein the layer comprising the second quaternary ammonium anti-static agent is overlaid on the layer comprising the first quaternary ammonium anti-static agent forming a discontinuous layer.

16. The method of claim 15 wherein discontinuities in the discontinuous layer are in a shape of dots or stripes.

17. A method for signaling depletion of an anti-static agent, comprising:

providing a substrate;

providing a layer with an anti-static agent;

blending a colorant into the layer comprising the anti-static agent;

applying the layer comprising the colorant and anti-static agent blend to the substrate wherein the colorant and anti-static agent blend overlay the substrate; and heating the substrate with the anti-static agent and colorant blend in a dryer so that the anti-static agent and colorant volatilize at a rate proportional to each other.

18. The method of claim 17 wherein the substrate is colored with a color complementary to the colorant blended with the anti-static agent.

* * * * *